United States Patent [19]

Hamanishi

[11] 4,031,871

[45] June 28, 1977

[54] EXHAUST GAS RECIRCULATION SYSTEM OF A MOTOR VEHICLE

[75] Inventor: Makio Hamanishi, Toyota, Japan

[73] Assignee: Toyota Jidosha Kogyo Kabushiki Kaisha, Toyota, Japan

[22] Filed: May 27, 1976

[21] Appl. No.: 690,656

[30] Foreign Application Priority Data

Mar. 2, 1976 Japan ..... 51-21757

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,802,402 | 4/1974 | Swatman | 123/119 A |
| 3,834,366 | 9/1974 | Kingsbury | 123/119 A |
| 3,880,129 | 4/1975 | Hollis | 123/119 A |
| 3,885,536 | 5/1975 | Marshall | 123/119 A |
| 3,926,161 | 12/1975 | Wertheimer | 123/119 A |

FOREIGN PATENTS OR APPLICATIONS

| | | | |
|---|---|---|---|
| 2,343,337 | 8/1973 | Germany | 123/119 A |
| 2,425,673 | 5/1974 | Germany | 123/119 A |

*Primary Examiner*—Wendell E. Burns

*Attorney, Agent, or Firm*—Stevens, Davis, Miller & Mosher

[57] ABSTRACT

This application discloses an improvement of an exhaust gas recirculation system of a motor vehicle, that is, in an EGR system which comprises:

a diaphragm type EGR valve mounted on an EGR pipe which connects the exhaust manifold and the intake manifold;

an opening path for air from the atmosphere diverged from a connecting pipe which connects the diaphragm chamber of said EGR valve and the EGR port near the carburetor throttle valve, and;

a diaphragm type vacuum control valve (VCV) arranged at the opening end of said opening path, the diaphragm chamber of said VCV communicating with the inlet of said EGR valve, the improvement disclosed in this application comprises another opening path for air from the atmosphere, which is diverged from the connecting pipe between said diaphragm chamber of said EGR valve and said EGR port, and another VCV, which operates in response to the vacuum pressure in the intake manifold, which is arranged at the opening end of said second opening path.

4 Claims, 2 Drawing Figures

EXHAUST GAS RECIRCULATION SYSTEM OF A MOTOR VEHICLE

BACKGROUND OF THE INVENTION

The present invention relates to an exhaust gas recirculation system (EGR system) which reduces Nitrogen Oxide emissions in the exhaust gas of a motor vehicle.

An EGR system is known which recirculates a part of the exhaust gases into the intake system of the engine so as to supply inert gases into the air/fuel mixture, for the purpose of lowering the combustion speed and the maximum combustion temperature of the air/fuel mixture, thereby reducing Nitrogen Oxide emissions in the exhaust gas. Two types of such an EGR system are known; one is an ON-OFF type EGR system and the other is a back pressure controlling type EGR system.

In the ON-OFF type EGR system, a two-position control EGR valve is arranged on the EGR pipe which interconnects the exhaust manifold and the intake manifold. When the engine starts, the EGR valve is opened and a part of the exhaust gas is sucked into the intake manifold by the suction force of the vacuum pressure in the intake manifold. When the engine is stopped, the EGR valve is closed and the EGR system does not operate. In this type of EGR system, however, under a light load condition of the engine the EGR ratio increases, especially when the number of revolutions of the engine is low. Accordingly, the output force of the engine is lowered and it becomes more difficult to obtain satisfactory engine performance.

In order to mitigate the above mentioned drawbacks in the ON-OFF type EGR system, a back pressure controlling type EGR system is known in which the EGR ratio is maintained substantially constant relative to the number of revolutions of the engine. This known back pressure controlling type EGR system comprises:

- a diaphragm type EGR valve mounted on an EGR pipe which connects the exhaust manifold and the intake manifold;
- an opening path for atmosphere diverged from a connecting pipe which connects the diaphragm chamber of said EGR valve and the EGR port near the carburetor throttle valve; and
- a diaphragm type vacuum control valve (VCV) arranged at the opening end of said opening path, the diaphragm chamber of said VCV communicating with the inlet of said EGR valve. However, in this type of EGR system, especially under a light load condition of the engine, the above mentioned drawbacks such as the output force of the engine being lowered are not acceptably obviated.

SUMMARY OF THE INVENTION

The object of the present invention is to provide an EGR system in which the EGR ratio is decreased under a light loaded condition of the engine by improving said back pressure controlling type EGR system. Therefore, according to the present invention, an improved back pressure controlling type EGR system is provided, wherein the improvement is that another opening path for air from the atmosphere is diverged from the connecting pipe between the diaphragm chamber of the EGR valve and the EGR port and that another vacuum control valve is arranged at the opening end of the second opening path, the second VCV being operated by the vacuum pressure in the intake manifold.

BRIEF DESCRIPTION OF THE DRAWINGS

The present invention will now be further described with reference to the accompanying drawings, in which.

DETAILED DESCRIPTION OF THE EMBODIMENTS OF THE INVENTION

Figure 1:
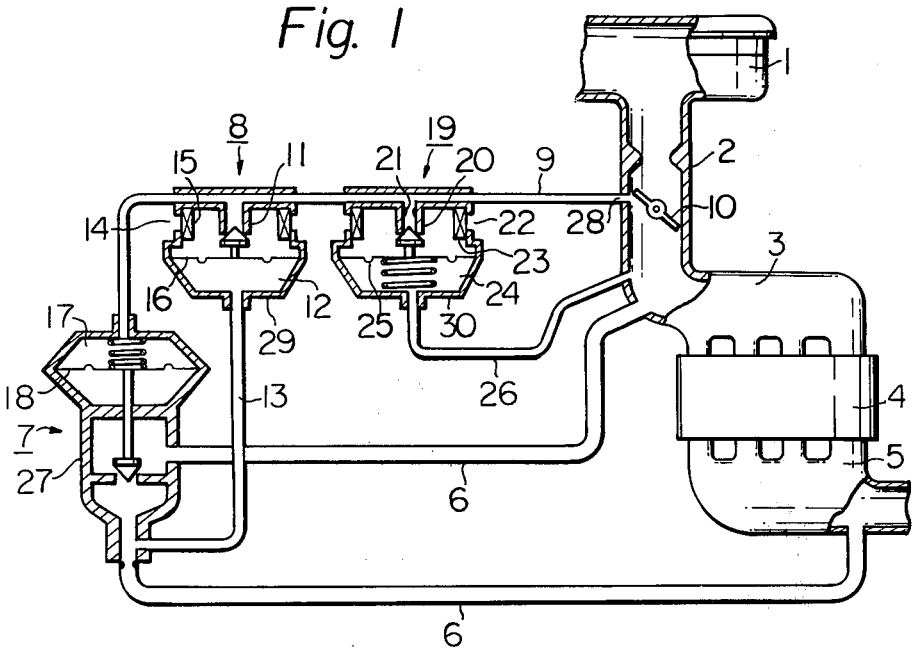
FIG. 1 is a diagrammatic view of the EGR system according to the invention.

In FIG. 1, 1 is an air cleaner, 2 is a carburetor, 3 is an intake manifold, 4 is an engine, 5 is an exhaust manifold and 10 is a throttle valve. The intake manifold 3 and the exhaust manifold 5 are interconnected by an EGR pipe 6 via an EGR valve 7. The EGR valve 7 has a diaphragm chamber 17 formed with a valve body 27 and a diaphragm 18. Said diaphragm chamber 17 is connected to the EGR port 28 arranged near the throttle valve 10 of the carburetor 2 through a connecting pipe 9. An opening path 11 for air from the atmosphere is diverged from the connecting pipe 9. A vacuum control valve (VCV) 8 is arranged at the opening end of said opening path 11. The inside of said VCV 8 is opened to the atmosphere through an opening 14 via a filter 15. The VCV 8 has a diaphragm chamber 12 formed with a valve body 29 and a diaphragm 16. The diaphragm chamber 12 communicates with the inlet of said EGR valve through a connecting pipe 13. Another opening path 20 for air from the atmosphere is diverged from said connecting pipe 9. Another vacuum control valve (VCV) 19 is arranged at the opening end of said opening path 20. The inside of this VCV 19 is opened to the atmosphere through an opening 22 on the valve body 30 via a filter 23. The VCV 19 has a diaphragm chamber 24 formed with a valve body 30 and a diaphragm 25. The diaphragm chamber 24 is connected to the intake manifold by a connecting pipe 26. An orifice 21 is arranged inside the opening path 20 for adjusting the amount of the intake air through this path.

The operation of the above EGR system is as follows. Before the engine 4 starts, the EGR valve 7 and the VCV 19 are closed while the VCV 8 is opened. When the engine 4 starts, the back pressure in the exhaust manifold 5 increases causing the pressure in the diaphragm chamber 12 of the VCV 8 to also increase with the result that the valve is closed. When the throttle valve 10 opens beyond a certain extent, the intake vacuum of the engine is applied to the diaphragm chamber 17 of the EGR valve 7 through the pipe 9. This results in the opening of the EGR valve 7 so that a part of the exhaust gas is recirculated through the EGR pipe 6. When the EGR valve 7 opens and the exhaust gas is recirculated, the pressure at the inlet of the EGR valve 7 decreases causing the communicating diaphragm chamber 12 of the VCV 8 to also decrease. This results in the opening of the VCV 8 so that the opening path 11 is opened to the atmosphere. Therefore, air from the atmosphere is introduced to the diaphragm chamber 17 of the EGR valve 7 through the pipe 9 with the result that the opening of the valve decreases and, accordingly, the amount of recirculated gas is decreased. When the opening of the EGR valve 7 is throttled, the pressure at the inlet increases and the VCV 8 operates so that the EGR valve 7 opens wider.

In this way the EGR valve 7 is controlled so that the EGR ratio is maintained substantially constant by controlling the pressure at the inlet of the EGR valve so that it is constant.

In the above described operation, when the intake air quantity of the engine decreases and the vacuum pressure in the intake manifold 3 exceeds a predetermined value, the pressure in the diaphragm chamber 24 of the VCV 19 is decreased by said vacuum pressure through the pipe 26. Accordingly, the VCV 19 opens so that the opening path 20 is opened to the atmosphere. Then the air from atmosphere is introduced into the diaphragm chamber 17 of the EGR valve 7 through the pipe 9. The amount of introduced air is adequately adjusted by the orifice 21. As a result, the opening of the EGR valve is minimized so that the quantity of the recirculated gas is decreased.

Figure 2:
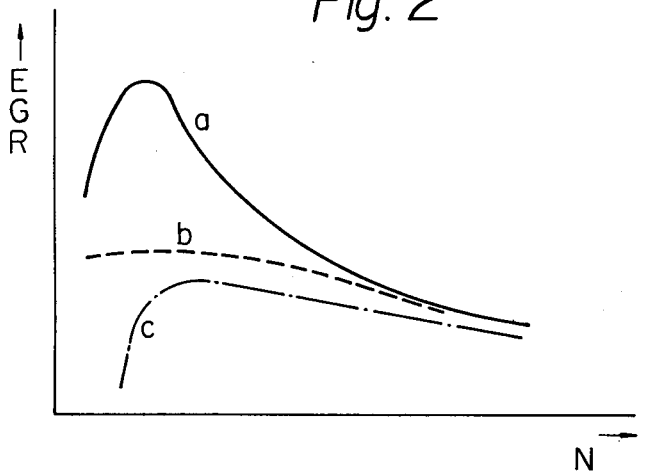
FIG. 2 is a graph showing the relationship between the revolution number N of the engine and the EGR ratio in various EGR systems.

FIG. 2 shows the relationship between the revolution number N of the engine and the EGR ratio in each of the above mentioned EGR systems under a light load condition of the engine. In FIG. 2 the solid line *a* indicates the ON-OFF controlling type EGR system, the dashed line *b* indicates the conventional back pressure controlling type EGR system and the dot-dash line *c* indicates the EGR system according to the present invention. As seen from the graph, especially when the number of revolutions N is small, the EGR ratio indicated by *c* is decreased much more than the others.

As explained above, when the quantity of the intake air of the engine decreases and the vacuum pressure in the intake manifold 3 exceed a predetermined value, air from the atmosphere, the amount of which is adjusted by the orifice 21, is introduced into the diaphragm chamber 17 of the EGR valve 7 by the operation of the VCV 19. As a result, the opening of the EGR 7 is decreased so that the amount of the recirculated exhaust gas is minimized. Accordingly, as the EGR ratio is decreased when the amount of intake air in the engine is small, the aforementioned drawbacks are acceptably obviated.

It should be understood that the VCV is not limited to the diaphragm type valve, and a known ON-OFF type valve may be used as the VCV cooperating with a vacuum detector which detects the vacuum pressure in the intake manifold.

What is claimed is:

1. In an exhaust gas recirculation system of a motor vehicle which comprises:

a diaphragm type EGR valve mounted on an EGR pipe which connects the exhaust manifold and the intake manifold;

an opening path for air from the atmosphere diverged from a connecting pipe which connects the diaphragm chamber of said EGR valve and the EGR port near the carburetor throttle valve, and;

a diaphragm type vacuum control valve (VCV) arranged at the opening end of said opening path, the diaphragm chamber of said VCV communicating with the inlet of said EGR valve, the improvement comprising another opening path for air from the atmosphere being diverged from the connecting pipe between said diaphragm chamber of said EGR valve and said EGR port, and another VCV, which operates in response to the vacuum pressure in the intake manifold, being arranged at the opening end of said second opening path.

2. An EGR system according to claim 1, wherein said second VCV is a diaphragm type valve, the diaphragm chamber of which communicates with the intake manifold through a connecting pipe.

3. An EGR system according to claim 1, wherein said second opening path for air from the atmosphere has an orifice for adjusting the amount of atmospheric air introduced through said opening path.

4. In an EGR system of a motor vehicle which comprises:

a diaphragm type EGR valve mounted on an EGR pipe which connects the exhaust manifold and the intake manifold;

an opening path for air from the atmosphere diverged from a connecting pipe which connects the diaphragm chamber of said EGR valve and the EGR port near the carburetor throttle valve, and;

a diaphragm type vacuum control valve (VCV) arranged at the opening end of said opening path, the diaphragm chamber of said VCV communicating with the inlet of said EGR valve, the improvement comprising another opening path for air from the atmosphere, which has a orifice for adjusting the amount of atmospheric air introduced through this opening path, being diverged from the connecting pipe between said diaphragm chamber of said EGR valve and said EGR port, and another diaphragm type VCV, the diaphragm chamber of which communicates with the intake manifold through a connecting pipe, being arranged at the opening end of said second opening path.

* * * * *